US005585905A

United States Patent [19]

Mammino et al.

[11] Patent Number: 5,585,905

[45] Date of Patent: Dec. 17, 1996

[54] PRINTING APPARATUS INCLUDING AN INTERMEDIATE TONER TRANSFER MEMBER HAVING A TOP LAYER OF A FLUOROELASTOMER POLYMERIZED FROM AN OLEFIN AND A FLUORINATED MONOMER

[75] Inventors: Joseph Mammino, Penfield; George J. Heeks, Rochester; Arnold W. Henry; Santokh S. Badesha, both of Pittsford, all of N.Y.

[73] Assignee: Xerox Corporation, Stamford, Conn.

[21] Appl. No.: 587,056

[22] Filed: Jan. 16, 1996

[51] Int. Cl.[6] ..... G03G 15/14

[52] U.S. Cl. ..... 355/272; 355/271

[58] Field of Search ..... 355/277, 279, 355/271, 275, 273, 272, 327; 430/33, 124, 126; 428/421, 411.1

[56] References Cited

U.S. PATENT DOCUMENTS

| | | | |
|---|---|---|---|
| 3,893,761 | 7/1975 | Buchan et al. | 355/3 R |
| 4,684,238 | 8/1987 | Till et al. | 350/10 |
| 4,690,539 | 9/1987 | Radulski et al. | 355/3 TR |
| 4,853,737 | 8/1989 | Hartley et al. | 355/289 |
| 5,099,286 | 3/1992 | Nishise et al. | 355/272 |
| 5,119,140 | 6/1992 | Berkes et al. | 355/273 |
| 5,132,743 | 7/1992 | Bujese et al. | 355/274 |
| 5,150,161 | 9/1992 | Bujese | 355/256 |
| 5,208,638 | 5/1993 | Bujese et al. | 355/274 |
| 5,233,397 | 8/1993 | Till | 355/279 |
| 5,337,129 | 8/1994 | Badesha | 355/275 |
| 5,340,679 | 8/1994 | Badesha et al. | 430/126 |

*Primary Examiner*—Arthur T. Grimley
*Assistant Examiner*—Quana Grainger
*Attorney, Agent, or Firm*—Zosan S. Soong

[57] ABSTRACT

There is disclosed an intermediate toner transfer member for use in an electrostatographic printing apparatus employing a liquid developer comprising: (a) a substrate; and (b) an outer layer comprised of a fluoroelastomer polymerized from a plurality of monomers, at least one monomer being an olefin having only carbon atoms and hydrogen atoms, and at least one monomer being fluorinated.

11 Claims, 2 Drawing Sheets

PRINTING APPARATUS INCLUDING AN INTERMEDIATE TONER TRANSFER MEMBER HAVING A TOP LAYER OF A FLUOROELASTOMER POLYMERIZED FROM AN OLEFIN AND A FLUORINATED MONOMER

This invention relates generally to an intermediate toner transfer member suitable for use in an electrostatographic printing machine, especially a liquid developer type printing machine. More specifically, the present invention is directed to an intermediate toner transfer member having an outer layer which includes a fluoroelastomer produced from at least two different monomers, wherein at least one monomer is an olefin having only carbon and hydrogen atoms, thereby allowing for low and controlled swelling of the outer layer of the intermediate member when the outer layer comes into contact with the liquid carrier of a liquid developer for an extended period of time. The phrase printing apparatus and similar phrases include copying devices.

When used in a liquid developer type printing apparatus, conventional intermediate toner transfer members which have an outer layer of a VITON™ type fluoroelastomer such as VITON GF™ (a tetrapolymer of vinylidene fluoride, hexafluoropropylene tetrafluoroethylene and a cure site monomer believed to include bromine) degrade relatively quickly because the outer layer does not absorb much of the carrier fluid, thereby adversely affecting the pressure transfix integrity of the outer layer by not allowing for the complete transfer of the toner to an image carrier such as paper. The outer layer of other conventional intermediate transfer members such as those based on silicone rubber may absorb the carrier fluid in an amount ranging for example from about 40 to about 75% by weight or more, based on the weight of the outer layer. These layers lose mechanical integrity quickly and crumble apart under normal pressure transfix image transfer conditions. Thus, there is a need for a new intermediate transfer member whose outer layer absorbs a lower amount of the carrier fluid to minimize swelling induced damage while maintaining good toner transfer and image fix properties.

Examples of an intermediate toner transfer member can be found in the following documents:

Hartley et al., U.S. Pat. No. 4,853,737, discloses rolls having an outer layer comprising cured fluoroelastomer containing pendant polydiorganosiloxane segments that are covalently bonded to the backbone of the fluoroelastomer. The outer layer provides a release surface that is abhesive to heat-softenable toner material.

Till, U.S. Pat. No. 5,233,397, discloses a liquid developer type electrophotographic printing machine which use an intermediate toner transfer belt made from silicone rubber or VITON™.

Buchan et al., U.S. Pat. No. 3,893,761, discloses an intermediate transfer belt having a polyimide film substrate coated with 0.1 to 10 mils of silicone rubber or a fluoroelastomer.

Till et al., U.S. Pat. No. 4,684,238 (e.g. col. 5) and Radulski et al., U.S. Pat. No. 4,690,539 (e.g., col. 6), disclose single layer intermediate transfer belts composed of polyethylene terephthalate or propylene material which are employed in liquid development methods and apparatus.

Berkes et al., U.S. Pat. No. 5,119,140, discloses a single layer intermediate transfer belt fabricated from clear TEDLAR™, carbon loaded TEDLAR™ or pigmented TEDLAR™.

Nishise et al., U.S. Pat. No. 5,099,286, discloses an intermediate transfer belt comprising electrically conductive urethane rubber as the substrate and a layer of polytetrafluoroethylene.

Bujese, U.S. Pat. No. 5,150,161, discloses suitable materials for laminate intermediate transfer members in a color printing apparatus, reference for example col. 7, line 48 to col. 8, line 38, and col. 11, lines 46–53.

Badesha et al., U.S. Pat. No. 5,340,679 (Attorney Docket No. D/92564), discloses an intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator.

Bujese et al., U.S. Pat. No. 5,132,743, discloses an intermediate transfer member which employs a conductive fluorosilicone layer.

SUMMARY OF THE INVENTION

It is an object of the present invention to provide intermediate toner transfer members suitable for liquid development systems whose outer layer has low swelling in carrier fluid.

It is also an object in embodiments to provide imaging apparatus and intermediate toner transfer members exhibiting high toner transfer efficiencies to and from the intermediate transfer members.

It is a further object in embodiments to enable generation of full color images with high color fidelity in imaging apparatus employing an intermediate toner transfer member.

It is an additional object to provide new intermediate toner transfer members which possess one or more of the following attributes: excellent chemical stability wherein the toner release layer (i.e., the outer layer) minimally reacts or does not react with the components of the liquid toners and developers including the toner resin, pigment(s)/dye(s), charge control additive(s), charge director(s), and carrier fluid; low surface energy; suitable dielectric thickness; suitable electrical conductivity; suitable thermal conductivity; good physical and mechanical stability; and good conformability.

These objects and others are accomplished in embodiments by providing an intermediate toner transfer member for use in an electrostatographic printing apparatus employing a liquid developer comprising:

(a) a substrate; and (b) an outer layer comprised of a fluoroelastomer polymerized from a plurality of monomers, at least one monomer being an olefin having only carbon atoms and hydrogen atoms, and at least one monomer being fluorinated.

There is also provided in embodiments an electrostatographic printing apparatus comprising:

(a) an imaging member for recording a latent image;

(b) a developing device including a liquid developer for developing the latent image with a toner composition to form a toner image;

(c) an intermediate toner transfer member, positioned adjacent the imaging member, comprising:

(i) a substrate, and (ii) an outer layer comprised of a fluoroelastomer polymerized from a plurality of monomers, at least one monomer being an olefin having only carbon atoms and hydrogen atoms, and at least one monomer being fluorinated; and (d) a transfer apparatus for transferring the toner image from the imaging member to the intermediate toner transfer member.

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
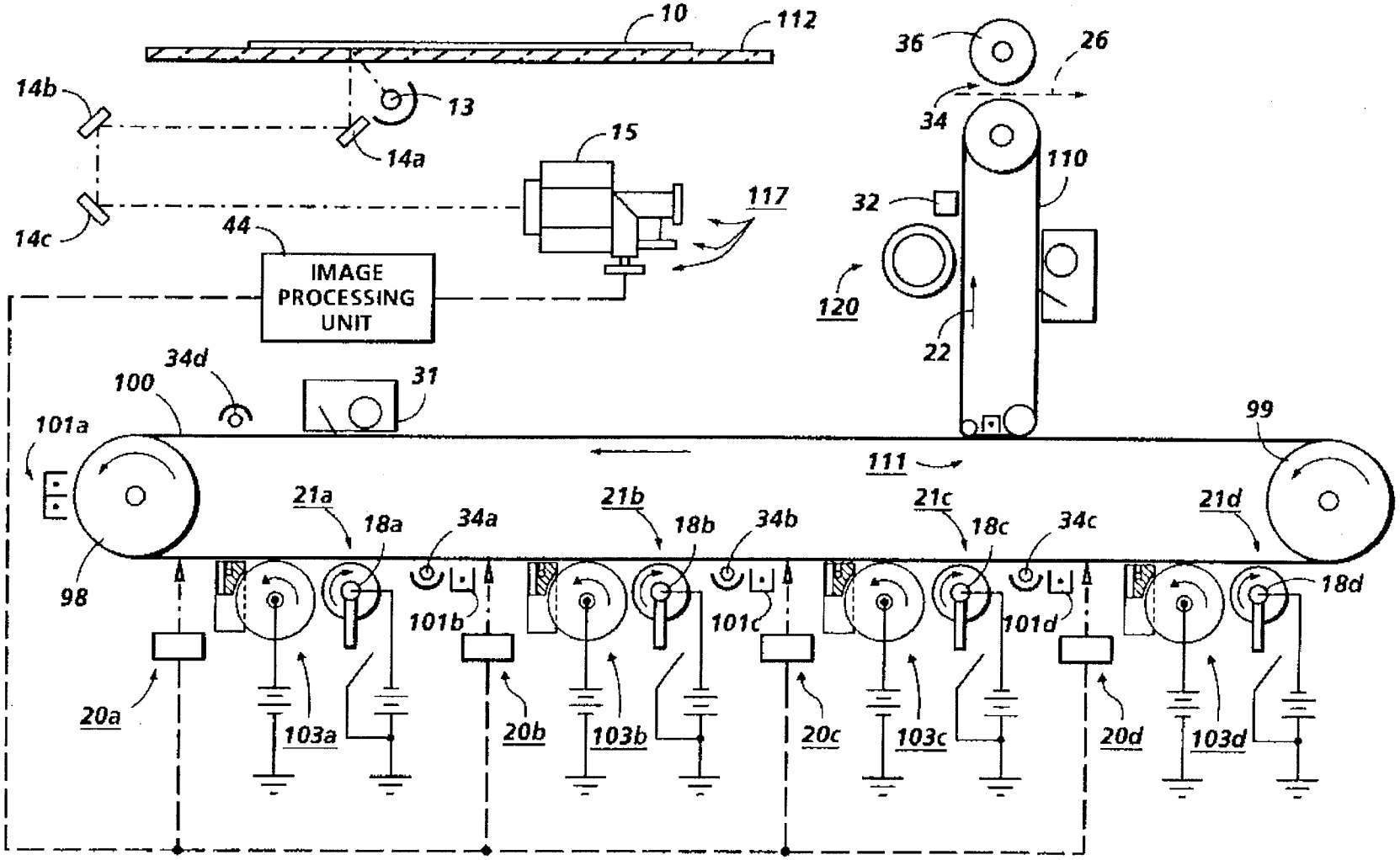
FIG. 1 represents an illustrative schematic, elevational view of a color electrostatographic printing machine.

Unless otherwise specified, the term monomer as used herein refers to a compound prior to polymerization of the fluorelastomer.

The fluoroelastomer is produced from a plurality of monomers such as two, three, four, or more monomers, some or all of which may be unsaturated. At least one monomer is an olefin having only carbon and hydrogen atoms, preferably an alkene having from 2 to 6 carbon atoms, and more preferably an alkene having from 2 to 4 carbon atoms. The olefin may have one, two, or more double bonds, and preferably only one single bond. Suitable olefins include for example ethylene, propylene, butene, pentene, and hexene, these olefins being linear or branched. The olefin monomer or monomers having only carbon atoms and hydrogen atoms may be present in an amount ranging for example from about 5 to about 70%, preferably from about 5 to about 50%, and more preferably from about 10 to about 25% by weight, based on the fluoroelastomer weight.

At least one monomer is fluorinated having for instance from 1 to 6 fluorine atoms, and preferably from 2 to 4 fluorine atoms. The fluorinated monomer may be unsaturated and preferably is an olefin such as alkene having for example 2 to 6 carbon atoms. Preferred fluorinated monomers include for example vinylidenefluoride, hexafluoropropylene, tetrafluoroethylene, hydropentafluoropropylene, and perfluoro(methylvinylether). The fluorinated monomer or monomers may be present in an amount ranging for example from about 95 to about 30%, preferably from about 95 to about 50%, and more preferably from about 90 to about 75% by weight, based on the fluoroelastomer weight.

The fluoroelastomer is formed from any combination of the monomers described herein. After polymerization of the monomers to form the fluoroelastomer, all or some of the monomer units in the fluoroelastomer may be saturated. Preferred fluoroelastomers include for example AFLAS™ a poly(propylene-tetrafluoroethylene) and FLUOREL II™ (LII900) a poly(propylene-tetrafluoroethylene-vinylidenefluoride), both available from the 3M Company. Some of the aforementioned fluoroelastomers that can be selected are believed to have the following formulas:

AFLAS™

$$\left(\left(\mathrm{CH}-\mathrm{CH}_2\right)\left(\mathrm{CF}_2-\mathrm{CF}_2\right)\right)_n$$

FLUOREL II™

$$\left(\mathrm{CH}_2-\mathrm{CF}_2\right)_x\left(\mathrm{CH}-\mathrm{CH}_2\right)_y\left(\mathrm{CF}_2-\mathrm{CF}_2\right)_z$$

wherein for the subscripts, n may range from about 3,000 to about 7,000, x may be 1.44, y may be 1, and z may be 1.46.

The outer layer of the intermediate toner transfer member has a thickness ranging for example from about 12.5 to about 625 microns, preferably from about 50 to about 250 microns, and more preferably about 125 microns. The outer layer may include conductive particles in the following illustrative amounts: about 3% to about 35% by weight, preferably about 5% to about 25% by weight, and more preferably from about 5% to about 10% by weight, based on the weight of the outer layer. The conductive particles may be for example carbon black, $SnO_2$, Sb doped $SnO_2$, ZnO, $TiO_2$, $BaTiO_3$, metal fibers, or powder particles of preferably submicron size to ensure good conductive linking throughout the material and for a good distribution during compounding. The metal fibers or powder particles may be aluminum, silver, or graphite. The conductive particles may have an arithmetic mean of the particle diameter from about 20 to about 100 millimicrons.

Other adjuvants and fillers may be incorporated in the outer layer in embodiments of the present invention providing they do not adversely affect the integrity of the outer layer. Such fillers may include coloring agents, reinforcing fillers, crosslinking agents, processing aids, accelerators and polymerization initiators. Adjuvants and fillers may be present in the outer layer in an amount ranging for example from about 5% to about 30% by weight, preferably from about 10% to about 15% by weight, based on the weight of the outer layer.

There may be an adhesive layer between the outer layer and the substrate. The adhesive layer may have a thickness ranging for example from about 2.5 microns to about 75 microns, and more preferably from about 25 microns to about 50 microns. Examples of adhesives include: THIOXON 403/404™ and THIOXON 330/301™ both available from Morton International of Ohio; GE-2872-074™ available from the General Electric Company which is believed to be a copolymer of polyimide and siloxane; a silane coupling agent such as Union Carbide A-1100 which is an amino functional siloxane; epoxy resins including bisphenol A epoxy resins available for example from Dow Chemical Company such as Dow TACTIX 740™, Dow TACTIX 741™, and Dow TACTIX 742™, and the like, optionally with a crosslinker or curative such as Dow H41 available from the Dow Chemical Company.

Examples of materials for the substrate include polyvinyl fluoride, such as TEDLAR®, available from E. I. DuPont de Nemours & Company, where the polyvinyl fluoride can be loaded with conductive or dielectric fillers such as carbon particles, titanium dioxide, barium titanate, or any other filler capable of decreasing dielectric thickness; polyvinylidene fluoride, such as KYNAR®, available from Pennwalt Corporation, where the polyvinylidene fluoride can be loaded with conductive or dielectric fillers such as carbon particles, titanium dioxide, barium titanate, or any other filler capable of decreasing dielectric thickness, certain papers, such as Xerox Corporation 4024 paper or Xerox Corporation Series 10 paper, and the like. In addition, metals that can be coated include aluminum, copper, brass, nickel, zinc, chromium, stainless steel, semitransparent aluminum, steel, cadmium, silver, gold, indium, tin, and the like. Metal oxides, including tin oxide, indium tin oxide, and the like, are also suitable. Any other material having the desired charge relaxation characteristics can also be employed. Fillers employed to alter the relaxation time of a material may be present in any amount necessary to effect the desired relaxation time; typically, fillers are present in amounts of from 0 to about 80 percent by weight. Preferably, the substrate is a metal, a metal oxide, a thermoplastic or a thermosetting organic film, including the materials disclosed herein. In embodiments, the substrate comprises polyimide, optionally including carbon black. The substrate thickness may range from about 25 microns to about 625 microns, preferably from about 50 microns to about 250 microns.

The intermediate toner transfer member can be of any suitable configuration including a sheet, a web, a foil, a strip, a coil, a cylinder, a drum, an endless belt, an endless mobius strip, a circular disc, or the like. Typically, the intermediate transfer member has a thickness of from about 25 to about 1250 microns, and preferably from about 50 to about 625 microns.

The intermediate member of the present invention in embodiments can have a charge relaxation time of no more than about $2\times10^2$ seconds to ensure efficient toner image transfer from the photoreceptor to the intermediate transfer member. The lower limit of suitable charge relaxation times is theoretically unlimited, and conductive materials, such as metals, can be employed as the transfer member. While not being limited by any theory, however, it is believed that the lower limit on the charge relaxation time for an intermediate transfer member in any given situation will be determined by the conductivity of the receiving substrate to which the toner image is ultimately transferred. Specifically, no shorting should occur between the intermediate transfer component and the photoreceptor or the final image carrying substrate around the toner piles constituting the image, since shorting would result in little or no transfer field to effect transfer of the toner image. Typically, for transfer to the intermediate transfer member, the charge relaxation time is from about $1\times10^{-3}$ seconds to about $2\times10^2$ seconds. The charge relaxation time ($\tau$) of a material is generally a function of the dielectric constant (K), the volume resistivity ($\rho$) of that material, and the permittivity of free space ($\epsilon_0$, a constant equal to $8.854\times10^{-14}$ farads per centimeter), wherein $\tau=K\epsilon_0\rho$.

The outer layer of the present intermediate transfer member is capable of absorbing an amount of the carrier fluid ranging from about 1 to about 25% by weight, and preferably, from about 2 to about 15% by weight, based on the weight of the outer layer. The inventive intermediate transfer member is advantageous since it will allow a low and controlled swell in the amounts discussed above of the outer layer in the carrier fluid while remaining physically stable. Some absorption of the carrier fluid into the outer layer is desirable in embodiments of the present intermediate transfer member in the amounts described herein to impart certain characteristics to the intermediate member such as good toner release. Preferably, toner transfer from the intermediate transfer member to the paper occurs via the pressure and fix process. In liquid ink development ("LID"), the LID toner image comprises toner particles and carrier fluid. The intermediate transfer member is heated to a temperature ranging from about 70 to about 150 degrees Celsius. The toner is softened and coalesces and forms a single layer together with the carrier fluid on the surface of the intermediate member. Pressure insures good contact and penetration of the softened toner/liquid image into the paper. The liquid which was absorbed in the intermediate member is squeezed out to the surface and acts as a weak boundary layer allowing complete toner transfer onto the paper. As the toner cools down after transfer to the paper, the excess liquid in the toner separates and is absorbed into the paper. The LID carrier liquids are generally aliphatic hydrocarbons and would swell and be absorbed by hydrocarbon based polymers, i.e, polyethylene, polypropylene, and the like. Too much liquid may be absorbed if the elastomer is entirely fabricated from an olefin monomer having only carbon and hydrogen atoms. However, too little liquid may be absorbed if the elastomer is entirely fabricated from a fluorinated monomer. Thus, the principle of the present invention involves controlling the amount of the olefin monomer or monomers having only carbon and hydrogen atoms (in the mixture with the fluorinated monomer or monomers) during the polymerization of the fluoroelastomer to achieve a low and controlled swell of the intermediate transfer member in LID carrier fluids.

The following discussion provides a general description of the operation of a liquid developer type electrostatographic printing machine which incorporates the instant intermediate toner transfer member.

Turning now to the FIG. 1, a photoreceptor 100 in the form of an endless belt is rotated along a curvilinear path defined by rollers 98 and 99. The photoreceptor 100 preferably includes a continuous multilayered belt including a substrate, an electrically conductive layer, an optional adhesive layer, an optional hole blocking layer, a charge generating layer, a charge transport layer, and, in some embodiments, an anti-curl backing layer. Initially, belt 100 is charged to a uniform potential at a charging station by charging unit 101*a*, which typically includes a corona generating device capable of spraying ions onto the surface of the photoreceptor 100 to produce a relatively high, substantially uniform charge thereon.

After a uniform charge is placed on the surface of the photoreceptor 100, the electrostatographic printing process proceeds by either inputting a computer generated color image into an image processing unit 44 or, for example, by placing a color input document 10 to be copied on the surface of a transparent imaging platen 112. A scanning assembly preferably comprising a high powered light source 13, mirrors 14*a*, 14*b* and 14*c*, a series of lenses (not shown), a dichroic prism 15 and a plurality of charge-coupled devices (CCDs) 117 operating in association with one another is provided, whereby light from the light source 13 is directed onto the input document 10 with the light reflected from the color document 10 being transmitted to the CCDs 117. The reflected light is separated into the three primary colors by the dichroic prism 15 such that each CCD 117 provides an analog output voltage which is proportional to the intensity of the incident light of each of the primary colors. Thereafter, the analog signal from each CCD 117 is converted into a digital signal corresponding individual picture elements or so-called pixels making up the original input document. These digital signals, which represent the blue, green, and red density signals, are inputted into the image processing unit 44 where they are converted into individual bitmaps representing the color components of each pixel (yellow (Y), cyan (C), magenta (M), and black (Bk)), the receptive values of exposure for each pixel, and the color separation therebetween. The image processing unit 44 can store bitmap information for subsequent images or can operate in a real time mode. The image processing unit 44 may also contain a shading correction unit, an undercolor removal unit (UCR), a masking unit, a dithering unit, a gray level processing unit, and other imaging processing sub-systems known in the art.

The digital output signals generated by the image processing unit 44 described hereinabove are transmitted to a series of individual raster output scanners (ROSs) 20*a*, 20*b*, 20*c* and 20*d* for writing complementary color image bitmap information onto the charged photoreceptor 100 by selectively erasing charges thereon. Each ROS writes the image information in a pixel by pixel manner. It will be recognized that the present description is directed toward a Recharge, Expose, and Develop (READ) process, wherein the charged photoconductive surface of photoreceptor 100 is serially exposed to record a series of latent images thereon corresponding to the substractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD) wherein charged areas are developed, can be employed as will be described.

As previously noted, the present intermediate member is utilized for carrying out the development process utilizing liquid developer materials, where the liquid developer units are depicted schematically at reference numerals 103*a*, 103*b*, 103*c* and 103*d*. Each developer unit transports a different color liquid developer material into contact with the electrostatic latent image so as to develop the latent image with pigmented toner particles to create a visible image. By way of example, developer unit 103*a* transports cyan colored liquid developer material, developer unit 103*b* transports magenta colored liquid developer material, developer unit 103*c* transports yellow colored liquid developer material, and developer unit 103*d* transports black colored liquid developer material. Each different color developer material comprises pigmented toner particles disseminated through a liquid carrier, wherein the toner particles are charged to a polarity opposite in polarity to the charged latent image on the photoconductive surface such that the toner particles pass by electrophoresis to the electrostatic latent image to create a visible developed image thereof. Each of the developer units 103*a*, 103*b*, 103*c* and 103*d* are substantially identical to one another.

Generally, the liquid carrier medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The toner particles can be any pigmented particle compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and U.S. application Ser. No. 08/268,608 the disclosures of each of which are totally incorporated herein by reference. The toner particles should have an average particle diameter from about 0.2 to about 10 microns, and preferably from about 0.5 to about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethylacrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Motfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, PrinteX® 140 V, available from Degussa, Raven® 5250 and Raven® 5720, available from Columbian Chemicals Company. Pigment materials may be colored, and may include magenta pigments such as Hostaperm Pink F (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer, a charge control additive sometimes referred to as a charge director may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

After image development, the liquid image on the photoconductor may be conditioned to compress the image and remove some of the liquid carrier therefrom, as shown, for example, by U.S. Pat. No. 4,286,039, among various other patents. An exemplary apparatus for image conditioning is shown at reference numeral 21*a*, 21*b*, 21*c* and 21*d*, each comprising a roller, similar to roller 18*a* which may include a porous body and a perforated skin covering. The roller 18*a* is typically biased to a potential having a polarity which inhibits the departure of toner particles from the image on the photoreceptor 100 while compacting the toner particles of the image onto the surface of the photoreceptor. In this exemplary image conditioning system, a vacuum source (not shown) is also provided and coupled to the interior of the roller for creating an airflow through the porous roller body to draw liquid from the surface of the photoreceptor, thereby increasing the percentage of toner solids in the developed image. In operation, roller 18*a* rotates against the liquid image on belt 100 such that the porous body of roller 18*a* absorbs excess liquid from the surface of the image through the pores and perforations of the roller skin covering. The vacuum source, typically located along one end of a central cavity, draws liquid through the roller skin to a central cavity for depositing the liquid in a receptacle or some other location which permits either disposal or recirculation of the liquid carrier. The porous roller 18*a* is thus continuously discharged of excess liquid to provide continuous removal of liquid from the image on belt 100. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

After image conditioning of the first developed image, the image on belt 100 is advanced to a lamp 34*a* where any residual charge left on the photoreceptive surface is extinguished by flooding the photoconductive surface with light from lamp 34*a*. Thereafter, imaging and development are repeated for subsequent color separations by first recharging and reexposing the belt 100, whereby color image bitmap information is superimposed over the previous developed latent image. Preferrably, for each subsequent exposure an adaptive exposure processor is employed that modulates the exposure level of the raster output scanner (ROS) for a given pixel as a function of the toner previously developed at the pixel site, thereby allowing toner layers to be made independent of each other, as described in U.S. application Ser. No 07/927,751. The reexposed image is next advanced through a development station and subsequently through an image conditioning station and each step is repeated as previously described to create a multi layer image made up of black, yellow, magenta, and cyan toner particles as provided via each developing station 103*a*, 103*b*, 103*c* and 103*d*. It should be evident to one skilled in the art that the color of toner at each development station could be in a different arrangement.

After the multi layer image is created on the photoreceptor, it is advanced to an intermediate transfer station where charging device 111 generates a charge for electrostatically transferring the image from the photoreceptor 100 to an intermediate transfer member 110. The intermediate member 110 may be in the form of either a rigid roll or an endless belt, as shown in the FIG. 1, having a path defined by a plurality of rollers in contact with the inner surface thereof. The intermediate member preferably comprises a multilayer structure comprising a substrate layer having a thickness greater than about 25 microns and a resistivity of about $10^6$ ohm-cm and insulating top layer having a thickness less than 10 micron, a dielectric constant of approximately 10, and a resistivity of about $10^{11}$ ohm-cm. The top layer also has an toner release surface. It is also preferred that both layers have a similar hardness of less than about 60 durometer. The intermediate transfer member is typically dimensionally stable in nature for providing uniform image deposition which results in a controlled image transfer gap and better image registration.

The multi layer image on the intermediate transfer member 110 may be image conditioned in a manner similar to the image conditioning described hereinabove with respect to the developed image on the photoreceptor 100 by means of a roller 120 which conditions the image by reducing fluid content while inhibiting the departure of toner particles from the image as well as compacting the toner image. Preferably, roller 120 conditions the multi layer image so that the image has a toner composition of more than 50 percent solids. In addition, the multi layer image present on the surface of the intermediate member may be transformed into a tackified or molten state by heat, as may be provided by a heating element 32. More specifically, heating element 32 heats both the external wall of the intermediate member and generally maintains the outer wall of member 110 at a temperature sufficient to cause the toner particles present on the surface to melt, due to the mass and thermal conductivity of the intermediate member. The toner particles on the surface maintain the position in which they were deposited on the outer surface of member 110, so as not to alter the image pattern which they represent while softening and coalescing due to the application of heat from the exterior of member 110. Thereafter, the intermediate transfer member continues to advance in the direction of arrow 22 to a transfix nip 34 where the tackified toner particle image is transferred, and bonded, to a recording sheet 26 with limited wicking thereby. At the transfix nip 34, the toner particles are forced into contact with the surface of recording sheet 26 by a normal force applied through backup pressure roll 36. Some of the advantages provided by the use of an intermediate transfer member include reduced heating of the recording sheet as a result of the toner or marking particles being pre-melted on the intermediate, as well as the elimination of an electrostatic transfer device for transferring charged particles to a recording sheet. Also because of the lower fuse temperature there is less paper curl.

After the developed image is transferred to intermediate member 110, residual liquid developer material may remain on the photoconductive surface of belt 100. A cleaning station 31 is therefore provided, including a roller formed of any appropriate synthetic resin which may be driven in a direction opposite to the direction of movement of belt 100, to scrub the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from lamp 34*d* in preparation for a subsequent successive imaging cycle. In this way, successive electrostatic latent images may be developed.

Thus, toner transfer may occur twice: (a) electrostatically from the photosensitive member to the intermediate transfer member; and (b) mechanically/thermally or electrostatically from the intermediate transfer member to the paper.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A first sample containing AFLAS comprised the following:

| | |
|---|---|
| AFLAS FA-150P (3M Co.) | 100 |
| THERMAX N-991 (R. T. VANDERBILT CO.) | 15 |
| VULCUP 40 KE (HERCULES INC.) | 4 |
| DRYMIX TAIC 75% (KENRICH PETROCHEMICALS INC.) | 4 |
| CARBOWAX 3350 (UNION CARBIDE) | 1. |

A second sample containing FLUOREL II comprised the following:

| | |
|---|---|
| FLUOREL II 1190 (3M CO.) | 100 |
| THERMAX N-991 (R. T. VANDERBILT CO.) | 15 |
| $Ca(OH)_2$ | 6 |
| MAGLITE D [Mg(O)] MERCK INC. | 3. |

The two samples were prepared as follows. The components in each of the above samples were milled in a rubber mill to form a homogeneous dispersion and then pressed into a single cavity mold and cured for 15 minutes at 350° F., then post cured for 16 hours at 400° F. The mold produced a pad of cured elastomer approximately 6×6 inch square× about 0.080 inch thick. The pads were cut to produce a disk of about 1 inch diameter and used to determine the swelling properties of the two samples in ISOPAR M which was the carrier liquid vehicle used to make up a liquid developer.

A third sample containing VITON GF as a control comprised the following:

| | |
|---|---|
| VITON GF (DU PONT) | 100 |
| MAGLITE D [Mg(O)] MERCK INC. | 3 |
| $Ca(OH)_2$ | 6 |
| C-50 CURATIVE (DU PONT) | 4. |

The VITON GF sample was dispersed, molded, and cured as discussed above except that the initial cure was for 40 minutes at 350° F. and post cured for 2 hours each at 200°, 300°, 350°, and 400° F. followed by 16 hours at 450° F.

Figure 2:
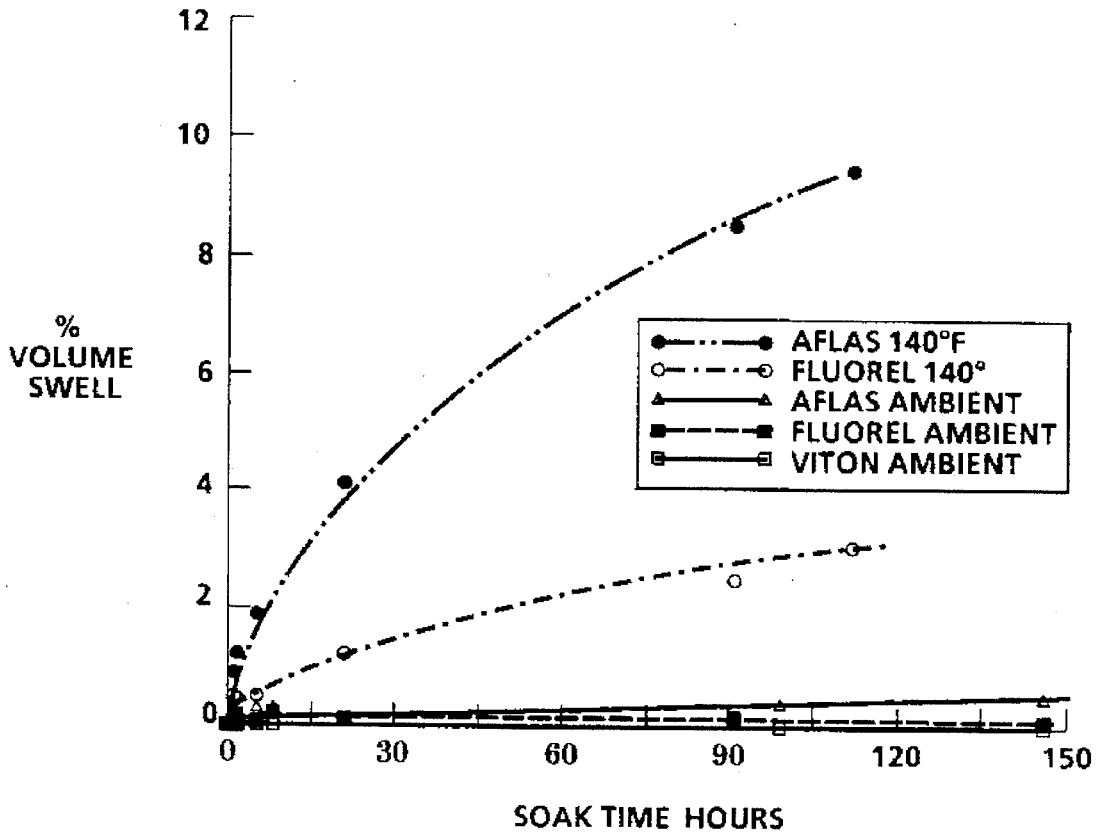
FIG. 2 is a graph depicting the percent volume swell versus soak time (hours) of three materials at ambient and elevated temperatures when soaked in a solvent.
Figure 3:
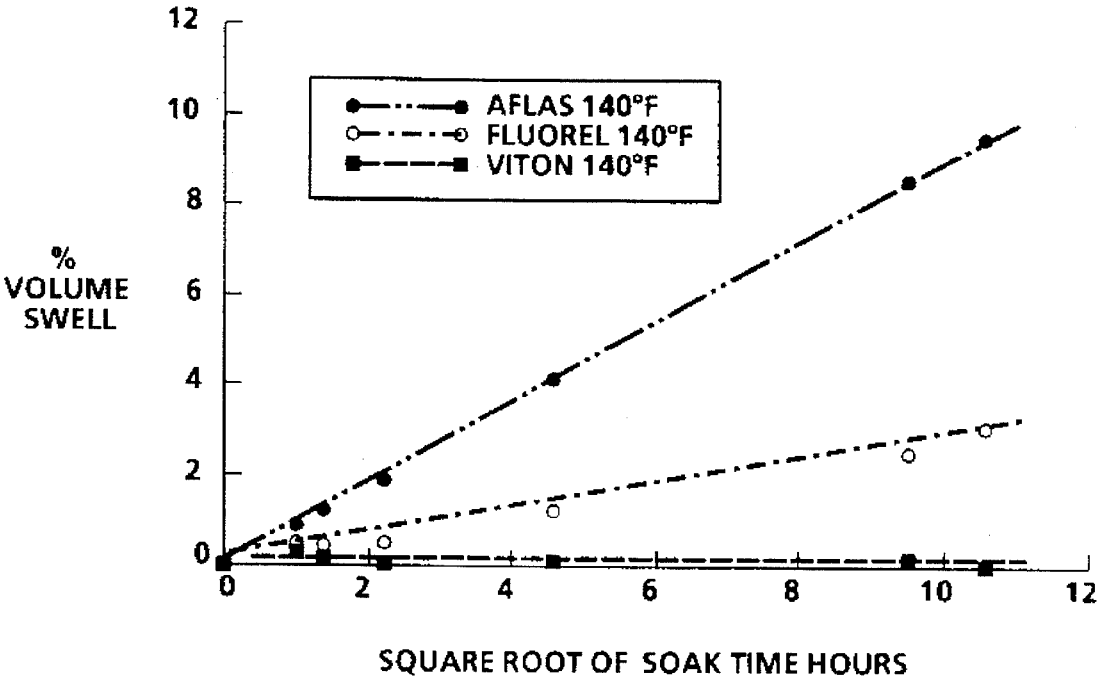
FIG. 3 is a graph depicting the percent volume swell versus soak time (square root of soak time hours) of three materials at elevated temperatures when soaked in a solvent.

The three samples were tested for the amount of swell in ISOPAR M at ambient temperature (i.e., about 25° C.) and at 140° F. As seen in FIGS. 2 and 3, The VITON GF sample failed to swell at all at ambient and marginally at 140° F. The FLUOREL II sample swelled a little, if at all, at ambient and some at 140° F., and the AFLAS swelled both at ambient and at 140° F. In addition, when soaked in ambient hexane for twenty hours, the VITON GF sample swelled 0.32%, the FLUOREL II sample 2.89%, and the AFLAS sample 23.3%. The above information suggested that swelling increased as the propylene (i.e., olefin having only carbon and hydrogen atoms) content of the elastomers increased with VITON GF having no propylene, FLUOREL II having some propylene content, and AFLAS having the most propylene content.

EXAMPLE 2

A portion of each of the milled and mixed AFLAS, FLUOREL II, and VITON GF samples before curing were dissolved in methyl ethyl ketone solvent to produce about a 20% by weight solids dispersion. The dispersion was applied onto a 3 mil thick Kapton film previously primed with THIOXON 330/301™ adhesive to produce a dry film coating of about 0.003 inch thick. Each coating was dried and cured as described in Example 1 to produce an intermediate toner transfer member. Each coating was immersed in ISOPAR M to reach a stabilized swell condition and then tested in a laboratory bench fixture to determine toner transfer. The bench tests showed that toner transfer from the VITON GF sample was poor after about 5 to 10 transfer cycles primarily because of blotchy toner transfer. Toner transfer from the FLUOREL II sample was complete and remained stable after more than 50 transfer cycles in the bench fixture. The AFLAS sample showed excellent toner transfer through several hundred test cycles with the widest fusing temperature latitude (70° to about 150° C.).

Other modifications of the present invention may occur to those skilled in the art based upon a reading of the present disclosure and these modifications are intended to be included within the scope of the present invention.

We claim:

1. An electrostatographic printing apparatus involving a toner image comprised of toner particles and carrier fluid, wherein the printing apparatus comprises:

(a) an intermediate toner transfer member comprising:

(i) a substrate, and (ii) an outer layer in contact with the toner image, wherein the outer layer consists essentially of a fluoroelastomer polymerized from a plurality of monomers, at least one monomer being an olefin having only carbon atoms and hydrogen atoms, and at least one monomer being fluorinated, and an additive selected from the group consisting of a filler, an adjuvant, and conductive particles, wherein the outer layer absorbs an amount of the carrier fluid from the toner image ranging from about 1 to about 25% by weight based on the weight of the outer layer; and (b) a transfer apparatus for transferring the toner image on the outer layer of the intermediate toner transfer member to a toner retaining member, wherein there is present on the outer layer carrier fluid along with the toner particles during the transfer of the toner image from the outer layer to the toner retaining member.

2. The apparatus of claim 1, wherein the transfer apparatus squeezes a portion of the absorbed carrier fluid out onto the surface of the outer layer wherein the squeezed out carrier fluid forms a boundary layer to enhance the transfer of the toner particles from the outer layer to the toner retaining member.

3. The apparatus of claim 1, wherein the outer layer absorbs an amount of the carrier fluid from the toner image ranging from about 2 to about 15% by weight based on the weight of the outer layer.

4. The apparatus of claim 1, wherein the olefin is an alkene.

5. The apparatus of claim 1, wherein the olefin is an alkene having from 2 to 6 carbon atoms.

6. The apparatus of claim 1, wherein the olefin is propylene.

7. The apparatus of claim 1, wherein the fluorinated monomer has 1 to 6 fluorine atoms.

8. The apparatus of claim 1, wherein the fluorinated monomer is unsaturated.

9. The apparatus of claim 1, wherein the fluoroelastomer is a copolymer or a terpolymer.

10. The apparatus of claim 1, wherein the fluoroelastomer is a copolymer of tetrafluoroethylene and propylene.

11. The apparatus of claim 1, wherein the fluoroelastomer is a terpolymer of tetrafluoroethylene, vinylidene fluoride, and propylene.

* * * * *